United States Patent [19]

Kronseder et al.

[11] 4,445,961

[45] May 1, 1984

[54] LABELING APPARATUS FOR BOTTLES OR THE LIKE

[75] Inventors: Hermann Kronseder, Donau; Reiner Bischkopf, Neutraubling, both of Fed. Rep. of Germany

[73] Assignee: Krones Aktiengesellschaft Hermann Kronseder Maschinenfabrik, Neutraubling, Fed. Rep. of Germany

[21] Appl. No.: 489,034

[22] Filed: Apr. 27, 1983

[30] Foreign Application Priority Data

Apr. 30, 1982 [DE] Fed. Rep. of Germany ..... 3216138

[51] Int. Cl.[3] ..... B65C 9/16; B65C 9/42

[52] U.S. Cl. ..... 156/364; 118/220; 118/231; 156/568; 156/571; 156/DIG. 32; 156/DIG. 45; 271/33

[58] Field of Search ..... 156/364, 567, 568, 571, 156/DIG. 29, DIG. 32, DIG. 45; 118/220, 231; 271/33, 258

[56] References Cited

U.S. PATENT DOCUMENTS

| | | | |
|---|---|---|---|
| 4,092,206 | 5/1978 | Zodrow | 156/568 |
| 4,127,435 | 11/1978 | Zodrow | 156/568 |
| 4,361,460 | 11/1982 | Kronseder | 156/568 |

*Primary Examiner*—Michael G. Wityshyn

*Attorney, Agent, or Firm*—Fuller, House & Hohenfeldt

[57] ABSTRACT

A bottle labeling machine has a turret rotating on a fixed axle. The turret has circumferentially spaced apart curved glue pallets mounted on individual pallet shafts supported in oscillatable drive members, respectively, which drive the shafts. The pallets orbit and oscillate to pick up glue from a roller, pick up a label next and deposit the label on a cylinder from which it is transferred eventually to a bottle. The drive members are externally splined axially and are each surrounded by an internally axially splined clutch member. The drive member has a smooth bore to permit it to rotate on a shaft that is driven in oscillating fashion as the turret rotates. The oscillating shaft has a transversely extending element on which there are axially projecting teeth that engage in corresponding recesses in the clutch member to effect oscillation of the pallet shaft. In response to an interruption in bottle delivery, a locking member on the turret engages the clutch member which rides off of the driving teeth to stop oscillation of the pallet when it is in a path that would clear the glue source, the label and the cylinder while the drive shaft is still controlled to oscillate but not sufficiently to reengage the teeth. As the turret rotates to the single position at about which the drive member was locked, the cam increases the oscillation amplitude to cause the teeth to reengage for driving the drive member again and no locking action will occur if there is no response resulting from an interruption in the series of bottles.

9 Claims, 4 Drawing Figures

Fig. 1
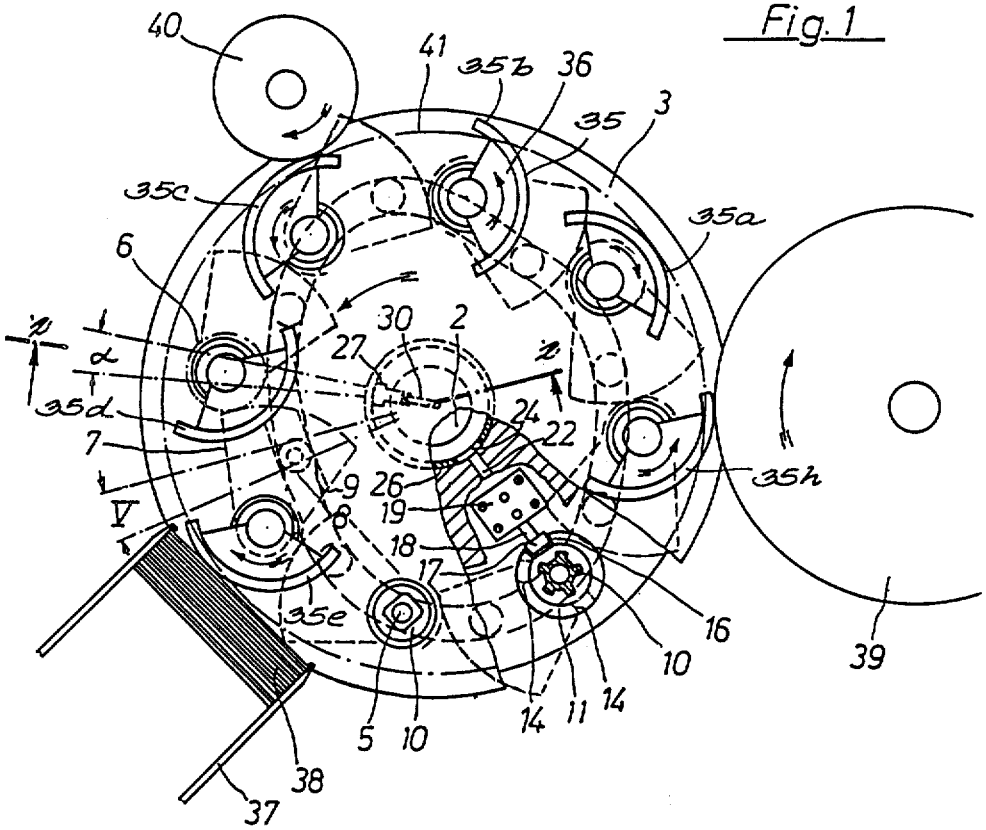
Fig. 3
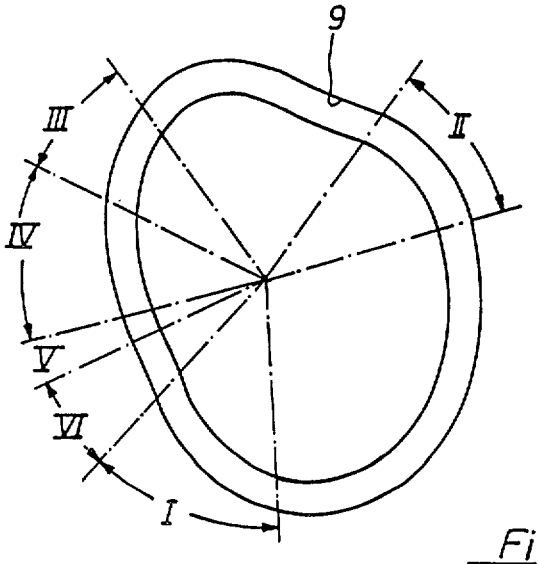
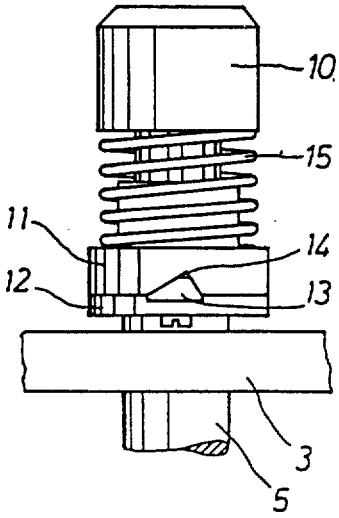
Fig. 4

LABELING APPARATUS FOR BOTTLES OR THE LIKE

BACKGROUND OF THE INVENTION

This invention relates to an automatic labeling machine of the type which has several curved glue pallets that are carried by a turret. The turret is driven rotationally at a constant speed to bring each pallet in contact with a glue application roller, and then to a stack of labels for picking one up and carrying it to a transfer cylinder wereupon the label is transferred to a bottle in a series of bottles that is being conveyed past the turret.

In machines of the type outlined, it is necessary to interrupt picking up of labels when there is an interruption in the series of bottles that are conveyed to the labeling machine in which case no bottle would be present for having the label transferred to it. Label pickup must start or stop synchronously with the supply of bottles to be labelled. When short gaps appear in the series of bottles, even a gap of just one bottle, label pickup must be stopped in relation to that bottle to avoid fouling the labeling machine with non-applied labels.

A labeling machine that is constructed to avoid picking up a label and, hence, avoid releasing the glue coated label when no bottle is present to receive it is described in U.S. Pat. No. 4,361,460 which issued on Nov. 30, 1982 in the name of one of the joint inventors of this application. In this patent in each pallet assembly there is a double-acting clutch member between a pallet shaft and a driven shaft that is for oscillating the pallet to properly position it and rock it at the glue application, the label pickup and the transfer cylinder locations. In one position, the clutch positively engages the pallet shaft and driven shaft for periodically oscillating the pallet from a radially retracted position to a radially extended position for successively contacting the glue application roller, the label source and label transfer cylinder. In its other position, the clutch member disengages the driven shaft and the pallet shaft and locks the pallet shaft to the turret, thereby retaining the pallet in its retracted position to pass by the label and prevent pickup and delivery of labels and glue. The clutch can be shifted from either position to the other only at an angular or rotational position of the turret in which the pallet is normally momentarily retracted and motionless with respect to the turret, so only an element of the clutch must be accelerated and decelerated to interrupt and resume the label pickup and delivery cycle. The movable element can have a very low mass and can thus be shifted quickly by applying a small force. The force is derived from pressurized air such that the clutch member is moved axially in the manner of a piston. In the patented apparatus, the slidable clutch member is splined to and slidable on a drive member which is in constant engagement with the pallet shaft by virtue of the drive member and pallet shaft being splined together. The dogs or projections on the clutch member that lock the pallet shaft drive member to the turret and the projections on the clutch member that lock the drive member to a cam driven shaft are on a common part, namely, the pallet shaft drive member. Thus, in one end position of the clutch member, the pallet shaft drive member is connected with the turret and prevented from rotating, and in the other end position the clutch member is connected to the cam driven shaft to thereby oscillate each pallet as is required for going through the glue application, label pickup and label transfer cycle. In this clutch arrangement, the pneumatically driven clutch member assumes an intermediate position in which the clutch member engages the pallet shaft drive member to secure it to the turret and prevent its rotation while at the same time the projections on the clutch member still bring about a connection between the pallet shaft drive member and the cam driven shaft. This intermediate position of the clutch member takes place during an interval when the turret and pallet drive member are standing still relative to each other as a result of the configuration of the cam that controls the driven shaft in this rotational position of the turret. The advantage of this arrangement is that the pallet shaft drive member and the cam controlled oscillating shaft are never allowed to rotate independently of each other so as to get out of synchronism. However, in the patented apparatus, it is conceivable that the slidable clutch member at the end of the interval during which there is no relative motion between the turret and pallet shaft drive member will not have completely reached its end position so that the parts will still be in engagement. This might happen, for example, if the air pressure which drives the clutch member is too low. Then, upon commencement of relative rotation between the cam-controlled shaft and the pallet drive member or turret, respectively, damage may occur in the clutch.

Another conceivable possibility is that the clutch member can be in the intermediate position temporarily and thus be completely free so that the pallet shaft is unlocked from the turret and the pallet shaft drive member is also unlocked from the cam-controlled shaft. In this case no damage could result but there could be an undesirable relative rotation between the pallet shaft and the turret or between the pallet shaft and cam-controlled drive shaft which would get the part out of synchronism.

SUMMARY OF THE INVENTION

The present invention is an improvement over U.S. Pat. No. 4,361,460 and over other prior art of which applicants are aware. In accordance with the invention, the pallet shaft drive member is connected to the cam-controlled drive shaft through an axially slidable clutch member. The clutch member is splined to and axially movable on the pallet drive shaft member. A spring presses the clutch member normally in engagement with the cam-controlled drive shaft. In this condition, the cam-controlled shaft oscillates the pallet shaft through all phases of its cycle for applying glue to the pallet, picking up a label and depositing the label on a transfer cylinder. A locking member that is driven by a pneumatic piston can be driven selectively into and out of engagement with the axially movable clutch member. In response to the absence of a bottle for receiving a label being detected, the pneumatic device engages the locking member with the clutch member to thereby positively lock a pallet shaft drive member and pallet shaft, of course, in a fixed position relative to the turret. During this locking step, the clutch member automatically disengages from the cam-controlled drive shaft and said drive shaft continues through an idling oscillation cycle with assurance that all parts will remain in synchronism with each other and be in synchronism when the next bottle is present for labeling. Thus, the drive connection is automatically interrupted only when the pallet drive shaft is locked securely to the turret. Even if by chance this locking of the pallet shaft to the turret would not take place during the interval when there is no relative rotation between the pallet shaft drive member and the turret the connection between the pallet shaft drive member and the cam driven shaft remains maintained. Hence, no damage can result nor will the pallet shaft drive member ever be free.

Other features and advantages of the invention will be evident in the description of a preferred embodiment thereof which will now be set forth in reference to the drawings.

DESCRIPTION OF THE DRAWINGS

FIG. 1 is a plan view of a labeling apparatus incorporating the invention, partly in section and with the cover removed;

FIG. 3 is a side elevation view of a drive, clutch and locking assembly as viewed generally in the direction of the arrow marked X in FIG. 2; and FIG. 4 is a plan view of a cam groove which is isolated from FIG. 1 and is for controlling the angular position of the respective drive shafts to which the pallet carrying shafts can be selectively coupled and uncoupled.

DESCRIPTION OF A PREFERRED EMBODIMENT

Figure 2:
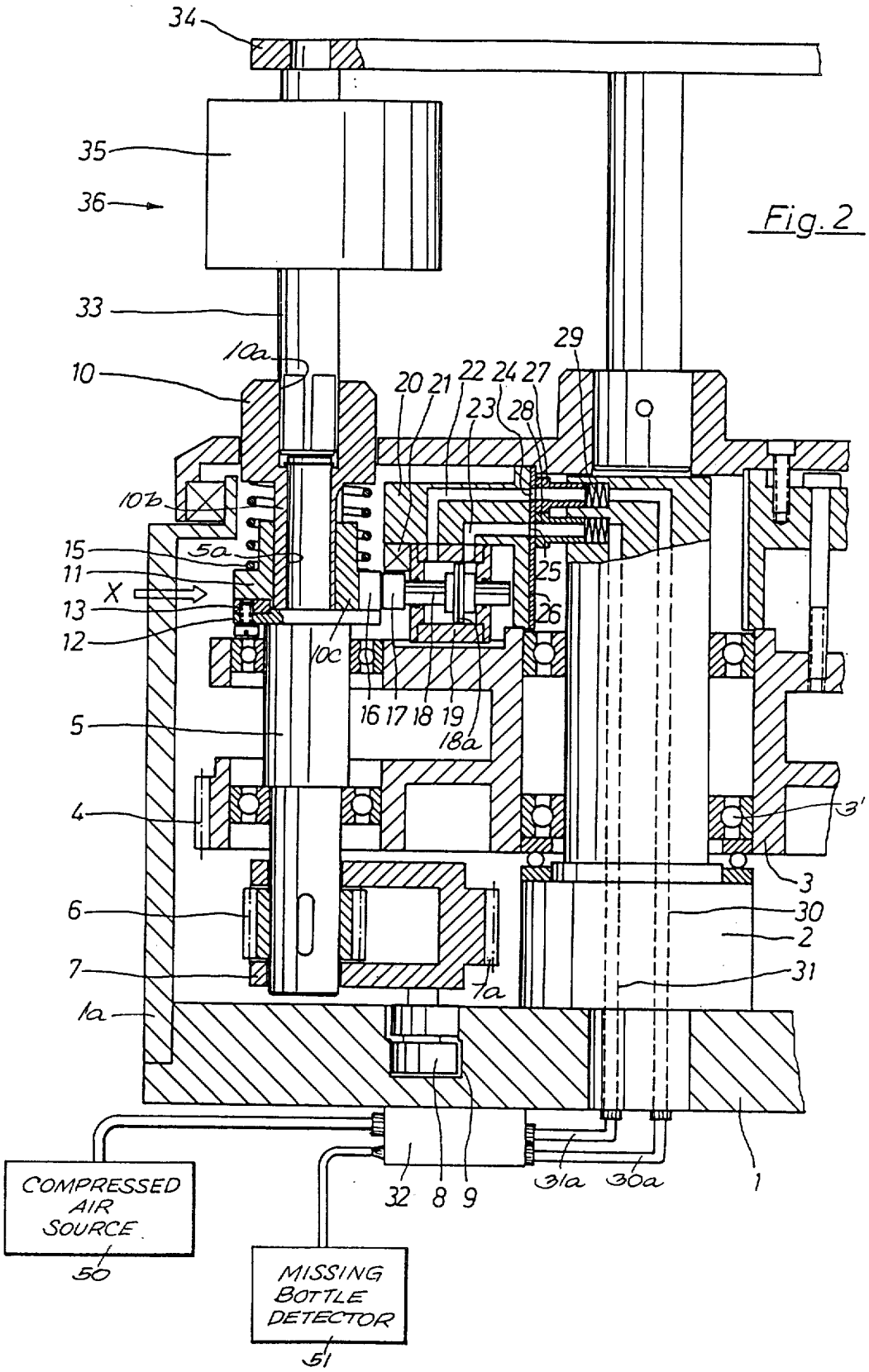
FIG. 2 is an enlarged section taken on a line corresponding with 2—2 in FIG. 1.

The ultimate functional objectives and general construction of the improved labeling apparatus are similar to the apparatus described in cited U.S. Pat. No. 4,361,460 which is incorporated herein by reference.

In FIG. 1, the labeling apparatus comprises a turret 3 on which there are eight equiangularly distributed label transfer assemblies that are designated generally by the reference numeral 36. Each of the assemblies is mounted for swinging about a vertical axis through a limited angle as the turret is driven rotationally. The label transfer assemblies 36 each have a curved pallet 35*a* through 35*h*. In FIG. 1 pallet 35*a* is presently swung to a position wherein its curved surface is tangential to or lying just inside of an imaginary circle 41 which circle is also just tangential to the foremost label 38 that is in a label container. As the turret 3 rotates, the pallet 35*b* which leads pallet 35*a* rotationally is beginning to swing counterclockwise on its approach to a glue applicator roll 40. The pallet marked 35*c* has just rolled its entire curved length over the periphery of the glue applicator roll 40. The pallet marked 35*c* has just rolled its entire curved length over the periphery of the glue applicator roll 40 in which case pallet 35*c* is presently coated with glue. In accordance with the invention if a detector which will be discussed later detects that there is no bottle present to receive a label, the pallet in the position designated 35*d* will be locked in the position in which it is shown so that it will pass the label 38 without picking it up. On the other hand, if a bottle is sure to be present at the label application point, the pallet which is in the position of pallet 35*e* will be allowed to roll its curved surface over a label and pick it up and carry it to the location where swingable pallet 35*h* is presently located. Pallet 35*h* makes rolling contact with a label transfer cylinder 39 which takes the labels off of the pallet and swings it around to a label-to-bottle transfer device, not shown. If one or more of the pallets 35 are locked inside of imaginary circle 41 at about the present location of pallet 35*d* they will remain locked for clearing labels 38, transfer cylinder 39 and glue applicator roll 40 and will be unlocked and be permitted to oscillate at the angular region marked $\alpha$ in FIG. 1 provided the presence of a bottle for receiving the label has been detected.

In FIG. 1, as in the cited patent, every shaft 5 that supports a label transfer assembly 36 has a gear segment 7 swingable on it. In FIG. 1, a typical gear segment 7 is shown in dashed lines. The gear segment which is swingable on a leading pallet shaft 5 for a pallet such as 35*e*, for example, has its peripheral teeth meshed with a pinion on the shaft 5 on which the next trailing pallet such as 35*d* swings. So any transfer assembly 36 has the gear segment 7 for swinging the next preceding or trailing assembly such as the one marked 35*d*. Each swingable gear segment 7 has cam follower rollers 8 mounted to it. The rollers follow a cam groove 9 which is in the stationary base plate 1 of the apparatus housing. Thus, as turret 3 rotates, the cam followers swing the gear segments 7 in a fashion that normally puts the orbiting label transfer assemblies 36 through the swinging cycles which they are seen to execute in FIG. 1. The structure and function thus far described is present in the apparatus described in cited U.S. Pat. No. 4,361,460. What is new in the present structure is a clutching device which locks the pallet that has attained the position of pallet 35*d* in FIG. 1 in the position in which it is shown so it will pass by the label 38 pickup station if the absence of a bottle is detected and which will disconnect the pallet from its drive shaft at the proper time so the driving force is not operating against a locked pallet while at the same time allowing the gear segment 7 to go through an operating cycle which will allow it to go into synchronism when the pallet that has been locked is unlocked in response to a bottle being present to receive a label picked up by the pallet.

In greater detail, the labeling apparatus depicted in FIGS. 1 and 2 comprises a housing having a stationary bottom 1. An annular member 1*a* is fastened to the bottom member 1 for confining various machine elements. A vertical axle 2, as shown in FIG. 2, is fastened to housing bottom member 1. There is a rotatable turret 3 that turns on bearings 3' relative to axle 2. The periphery of turret 3 has a ring gear 4 fixed to it through which it may be set in constant rotation in the direction of the arrow in FIG. 1 by driving means that are not shown. In the turret 3 there are eight equiangularly spaced apart shafts 5 that are radially equally distant from fixed axle 2 and have their axes parallel to the axis of axle 2. On the lower end of each shaft 5 a pinion gear 6 is fixed by means of a key and there is a gear segment 7 that is swingable on shaft 5. The teeth of any gear segment 7 mesh with the pinion gear 6 of the next preceding shaft 5 trailing in the rotational direction of the turret. Each gear segment 7 has mounted to its lower side two rotatable cam follower rollers 8. The cam rollers 8 reside in a closed loop cam groove 9 formed in the bottom of stationary housing 1. The shape of the cam groove 9 can be seen in FIGS. 1 and 2.

The new clutch mechanism for selectively coupling and uncoupling the drive shafts 5 and the driven shafts 33 for the pallets 35 will now be described. At its upper end, each shaft 5 has a smooth reduced diameter part 5*a* on which a drive member 10 is positioned for free rotation. The upper part of drive member 10 has a greater outside diameter than the part extending integrally from it and below it. This upper part has a polygonal bore 10a. The complementarily shaped lower end of pallet shaft 33 fits into bore 10a of drive member 10. The lower lesser outside diameter part 10b of drive member 10 has external axially extending splines 10c. On this externally splined part 10c there is an axially slidable and internally splined clutch member 11 having a flat lower end surface which interfaces with a horizontal disk 12 that is rigidly connected to the shaft 5. On the upper end surface of disk 12 are fixed two axially projecting generally triangular teeth 13 separated by an angle of 180° from one another. As can be seen best in FIG. 3, each of the two teeth 13 are beveled or inclined on one side at an acute angle of about 20°, for example, with respect to the plane of the horizontal disk 12 while the other side of the projecting teeth are inclined at a greater angle of up to 90°. The tips or apices of the respective teeth 13 are cut off or truncated horizontally. The axially slidable clutch member 11 has on its otherwise smooth lower end two recesses 14 complementary in shape to the upwardly projecting teeth 13. Recesses 14 are capable of having the two teeth 13 register fully in them in one relative position of disk 12 and slidable clutch member 11. By means of a pre-stressed helical compression spring 15 interposed between a shoulder on axially immovable drive member 10, the clutch member 11 is normally pressed downwardly against the disk 12. The teeth could be on the clutch member 11 and the recesses on the disk 12. In any case the teeth and cooperating recesses are given the beveled shape to assure that the teeth will ride out of the recesses and lift the clutch member when the member is locked against rotation while a drive shaft 5 continues to turn. When the teeth and recesses are registered, clutch member 11 follows oscillations of shaft 5 and member 11, being splined to drive member 10 oscillates it so the pallet shaft 33 and its curved pallet 35 oscillates.

On the outer periphery of clutch member 11 there is a single recess 16 slightly tapering or converging radially inwardly of member 11. Recess 16 is adapted to have registered in it a complementarily-shaped detent or locking member 17. Locking member 17 is fixed directly on a piston rod 18 which has a piston 18a in a pneumatic cylinder 19 which is fastened to the lower side of a boss 20 between the stationary axle 2 and the rotational path of the shafts 5 so the cylinder is effectively fastened to the turret 3. Boss 20 is fastened by means of several screws, not shown, to turret 3. Pneumatic cylinder 19 is arranged such that the locking member 17 in the radially inward end or limiting position of the piston rod 18 relative to axle 2 lies opposite the outer periphery of the axially shiftable clutch member 11 at the level of recess 16 in the clutch member with a small clearance between them normally. For stability during rotation of locking member 17 or the piston rod 18 there is a slide or slip ring 21 which is fixed on the low side of boss 20 and contacts the locking member 17.

If piston driven locking member 17 is in its radially inward end or inactive position and not inserted in recess 16 of clutch member 11 as depicted in FIG. 2, the pallet drive member 10 can rotate freely on shaft 10 and the clutch member 11 can rotate with it. At this time, the teeth 13 extending up from the flat disk 12 on shaft 5 are held engaged with the grooves 14 in the clutch member under the force of the helical compression spring 15, so that the pallet drive member 10 follows the rotation of shaft 5 and splined clutch member 11 does not shift axially on the drive member spline 10a. If, on the other hand, the locking member 17 is driven into the recess 16 of clutch member 11 and the member, being splined to the pallet drive member 10, holds the drive member against rotation on shaft 5, this also blocks rotation of shaft 33 which is coupled to drive member 10 and supports a glue pallet 35. But the gear segment 7 on the adjacent leading shaft 5 still tends to turn the trailing shaft 5 under consideration. Hence, the slidable clutch member 11 upon rotation of shaft 5 in a clockwise direction as viewed from above, is lifted by means of the approximately 20° beveled tooth 13 surface riding out of the correspondingly beveled grooves 14 in the lower end of clutch member 11 and onto the flat lower end surface of the clutch member to permit shaft 5 to turn freely in the pallet shaft drive member 10. If a shaft 5 under consideration in the further course of its swinging movement as determined by the cam follower 8 position along cam groove 9 again runs through a certain swinging position the clutch member 11 drops down and the teeth 13 and grooves again engage with one another and shaft 5 is engaged again with the clutch member 11. If detection of a missing bottle occurs and clutch member 11 becomes locked, the cam groove 9 configuration is such that the next leading gear segment 7 will be compelled to swing through a more limited angle which causes the teeth 13 to remain riding on the flat lower end of clutch member 11 but not through sufficient angle to permit re-registry in recesses 14 until a place is reached in the region α or V when the cam groove 9 compels maximum swing to reset the teeth in the recesses. If at this moment, the piston driven detent or locking member 17 is drawn out of the peripheral recess 16 in clutch member 17 the rotational driving connection between shaft 5 and drive member 10 remains secure. If, however, the locking member 17 remains in the clutch member recess 16, then automatic uncoupling of shaft 5 from the clutch member repeats. Thus, to summarize, when the locking member 17 is driven into engagement with clutch member 11, the clutch member is stopped from rotating. Since member 11 is spline connected to drive member 10 it is stopped. This means that shaft 33 and curved glue pallet 35 cannot turn and will stay locked against turning as the pallet orbits with turret 3. Since shaft 5 and clutch member 11 would continue to receive an oscillating driving force through the agency of cam-driven gear segment 7 on the next orbitally leading shaft 5, it is necessary to uncouple driven shaft 5 from clutch member 11 and this is done by letting the shaft turn to cause the two teeth to slip out of the end recesses 14 of the clutch member and ride on its lower flat surface between the recesses by action of the cam on the gear segment provided that the locking member becomes disengaged.

Locking member 17 is extended radially outwardly and retracted to the position in which it is shown presently in FIG. 2 by applying compressed air to opposite sides of piston 18a in pneumatic cylinder 19. For this purpose, the two chambers defined on opposite sides of piston 18a of cylinder 19 are connected by means of channels 22 and 23 in boss 20 with two vertically aligned slots 24 and 25, respectively, which are arranged above one another in a cylindrical sleeve 26 fixed in the bore of boss 20. In alignment with the circular path of rotation of each control slot 24 and 25 in sleeve 26 there are tubular shoes 27 and 28 which are fitted radially slidably in the stationary axle 2 and are pressed radially-outwardly from the axle by compression springs such as the one marked 29. Each of the shoes 27 and 28 has a longitudinal bore and is connected with channels 30 and 31, respectively, formed in the interior of axle 2. Channels 30 and 31 are connected through conduits 30*a* and 31*a* with an electromagnetic control valve 32 fixed on the lower side of the housing bottom 1. Control valve 32 is connected to a source of compressed air 50 and to a missing bottle detector 51 which was located at the inlet in the machine for the series of conveyed bottles that are to be labelled. Control valve 32 is operated intermittently so that upon passing of the spring biased tubular shoes 27 and 28 over slots 24 and 25 one or the other of the chambers on the sides of piston 18*a* is supplied with compressed air and the other chamber is simultaneously evacuated. Through proper choice of the circumferential length of the control slots 24 and 25, even at high rates of turret rotation, there is adequate time for sufficient pressurization on one side or the other of the piston 18*a* to drive it to its limiting positions. The frictional drag exerted by means of packings for the piston and piston rod is sufficient to keep the piston in any position to which it has been shifted by air pressure. In addition, the locking member 17 is held normally disengaged from clutch member 11 by means of the uninterrupted circular periphery of the clutch member 11 on both sides of recess 16 and is held engaged to clutch member 11 by means of frictional forces between its sides and those of recesses 16. Observe also that when compressed air is supplied, the spring biased tubular shoes 27 and 28 act as differential pistons and are thus additionally pressed against sleeve 26 to develop a good seal and yet not create an appreciable amount of wear.

The polygonal bore 10*a* in the upper end of each drive member 10 receives the correspondingly profiled pallet shaft 33 which is rotatably supported at its upper end in a cover plate 34 rotating with turret 3. The pallet shaft 33 carries a pallet 35 provided with a curved surface on which glue is applied so the surface can contact and pick up one of the labels 38 from the label stack in container 37 shown in FIG. 1. The label pickup and transfer assembly, designated generally by the numeral 36 in FIG. 1 as previously indicated, and its curved glue pallet 35 is eccentric to the axis of rotation of pallet shaft 33.

When the series of bottles fed to the labeling apparatus has no interruption of missing bottle a positive connection is maintained between pallet shaft drive member 10 and drive shaft 5 so each curved glue pallet 35 will oscillate in a predetermined pattern as it orbits with turret 3 and the oscillations are predetermined by the cam groove 9 acting on cam rollers 8 of the next orbitally leading shaft 5. Normally, that is unless there is a gap or missing bottle or interruption in the bottle feed, one of the curved pallets 35 at a time contacts and rocks on an exposed label 38 in the container 37 and, by means of glue already applied to the pallet removes a label 38. This happens along Area I of the cam groove 9 in FIGS. 4 and 1. As shown in FIG. 1, the label picked up is then transferred to labeling cylinder 39 in cam groove Area II. After transferring a label from the pallet in position 35*h* to cylinder 39, the pallet swings and orbits with turret 3 and is in the case of pallet 35*d* rocks on glue applicator roller 40 rotating in the direction of the arrow for coating the pallet with glue and this occurs in Area III of the cam groove 9. Then the pallet carrying members 36 are swung inward until they lie completely within the imaginary circle 41 which is concentric with turret axle 2 and tangent to the foremost label 38 in the stack. Label transfer members 36 and their pallets 35 are inside of imaginary circle 41 as they pass through Area IV. As the stack of labels is tangent to circle 41, in this relative position no contact is possible between a pallet 35 if the pallet is held in its Area IV condition as it passes the labels. In accordance with the invention, a pallet is automatically held this way if no bottle is present to receive the label. In this relative position, the label transfer assemblies 36 travel through a small angular range $\alpha$ at a complete standstill with respect to the turret 3 as in Area V. Thereupon, the transfer members 36 are normally swung into the starting position for label removal provided the pallet shaft drive member 10 is coupled with shaft 5 in Area VI as would be the case if there is no interruption in the bottle feed. As is apparent from FIG. 1, the two shoes 27 and 28 are arranged exactly in the range of rotation angle $\alpha$ of the label transfer members 36. Only in this area, as is apparent in FIG. 2, the recess 16 in clutch member 11 is exactly aligned with the pneumatically actuated locking member 17. If the pneumatic cylinder 19 is supplied with compressed air through inlet 23 at this time the locking member 17 will be driven into recess 16 and if it is supplied through inlet 22 it will be pulled out of recess 16 in axially movable clutch member 11.

The labeling apparatus just described functions as follows: If the missing bottle detector 51 detects the beginning of the bottle feed or the absence of any interruption in the sequence of bottles being fed to the apparatus, the detector provides a signal to control valve 32 which responds by applying air pressure to channel 30 to thereby drive piston 18*a* radially inwardly or toward axle 2 and keep the locking member 17 out of engagement with recess 16 in axially movable clutch member 11. At this time the other channel 31 is evacuated by way of discharge out of control valve 32. The control valve 32 remains in this state as long as picking up of labels by the pallets 35 is appropriate. If a gap in the bottle series is detected, channel 30 is pressurized and channel 31 is evacuated to thereby drive locking member 17 into engagement with clutch member 11. On the other hand, if the locking member 17, on account of there having been a previously effective label removal operation, is already in unengaged condition, then the compressed air has no further effect. The connection between drive shaft 5 and the pallet shaft driving member 10, through the agency of clutch member 11, is simply maintained. The leading label removal assembly accordingly completes the oscillating movement of the shaft 5 in question and removes and transfers a label. If, on the other hand, the locking member 17 on account of being just previously locked for label removal encounters control slots 24 and 25 on shoes 27 and 28 and is in its radially outer, that is, coupled, condition then it is now drawn out of recess 16. At the same time, in the angle area $\alpha$, the compression spring 15 moves the clutch member 11 downward to thereby restore the coupling between drive shaft 5 and pallet shaft drive member 10. If the missing bottle detector signals an opening or interruption in the bottle supply or the end of the bottle feed, the control valve 32 changes state at a suitable point in time, that is, after passing by of one of the pallets that still removes a label and at the latest upon encountering a removal member 36 no longer removing a label in the angle area $\alpha$, so that now channel 31 is pressurized and channel 30 is evacuated to drive the locking member 17 into engagement with the clutch member. Accordingly, upon encountering of control slots 24 and 25 on shoes 27 and 28, the radially outer chamber of the pneumatic cylinder is pressurized and the inner chamber is evacuated. Thus, the piston rod 18 and its locking member 17 is forced radially outwardly so that the locking member engages in recess 16 as soon as it is exactly flush with the same. Then the pallet shaft drive member 10 is fixed with its curved pallet 35 secured against rotation relative to turret 3 and entirely within imaginary circle 41 so that no further label removal can take place. Upon further rotation of drive shaft 5 there is an automatic uncoupling of the clutch.

Driving of the pallet shaft drive member 10 is thus interrupted by the action of the cam groove 9 on a gear segment 7 drive shaft 5 so the shaft 5 rotates to an idling state. There is contact of the locked pallet 35 with the label transfer cylinder 39 and the glue application roller 40. When the particular locked label removal member 36 again reaches the angular range $\alpha$, air pressure disengages the locking member and label removal by the previously locked member is resumed.

We claim:

1. Apparatus for labeling bottles or the like comprising a turret rotatable on a stationary support; a source of glue, a source of labels and a label transfer cylinder positioned around the rotational path of the turret; at least one glue pallet on a pallet supporting shaft and having a curved surface and mounted to said turret for rotation eccentrically about an axis radially spaced from the turret rotational axis; and drive means for periodically oscillating the pallet shaft supporting said pallets about said radially spaced axis between a radially retracted position for permitting the pallet to pass by said glue source, said label source and said label transfer cylinder and a radially extended position for permitting said pallet to successively contact said glue source, to remove a label from said label source, and to transfer the glue coated label to said transfer cylinder; and, a mechanism for selectively disengaging said drive means from a pallet and locking said pallet in radially retracted position and for reengaging said drive means, comprising:

said pallet shaft and a drive shaft aligned on said eccentric axis, said pallet shaft having a first end fastened to said pallet, said drive shaft having a first end driven by said drive means, and said pallet and drive shafts having adjacent second ends, a drive member rotatable on said second end of said drive shaft and engaged with said pallet shaft for oscillating said pallet, a clutch member engaged with said drive member for oscillating therewith and movable axially on said drive member, said clutch member having an axially presented surface, an element having a surface presented toward said clutch member surface and the element being fastened to said drive shaft adjacent said surface, one of said surfaces having teeth projecting from it and the other having corresponding recesses with which said teeth may selectively engage and disengage such that when there is engagement said drive shaft will oscillate said pallet, spring means for biasing said clutch member axially to hold the teeth in the recesses whereby to effect a driving relationship between said drive shaft and clutch member, a locking member and operating means therefor mounted on said turret for selectively operating said locking member momentarily when said turret is in one rotational position to engage said clutch member when said pallet is in retracted position to thereby cause disengagement of said clutch member and drive shaft by reason of said clutch member moving axially and relative rotation between said teeth and said recesses for said drive shaft to be permitted to continue oscillating while said pallet remains locked in retracted position.

2. The apparatus according to claim 1 wherein said locking member operating means comprises a fluid pressure cylinder mounted to said turret for rotation therewith and including a piston and piston-rod extending therefrom and carrying said locking member, said clutch member having a circular periphery and a recess in its periphery into which said locking member registers to lock said clutch member and the pallet drive member coupled thereto against rotation.

3. The apparatus according to claim 2 wherein said piston-rod is directed along a radius from said turret rotation axis toward said clutch member

4. The apparatus according to any of claims 2 or 3 wherein said locking member is tapered toward said clutch member and said recess in the clutch member has a complementarily shaped taper.

5. The apparatus according to claim 1 wherein said teeth have double-beveled shapes and said recesses for the teeth have substantially complementary shapes.

6. The apparatus according to claim 5 wherein said teeth are beveled or inclined at a small acute angle relative to said plane of rotation to preclude positive interlock between the teeth and cooperating recesses.

7. The apparatus according to any one of claims 1, 2, 3, 5 or 6 wherein said clutch member is engageable by said locking member only when said oscillating drive shaft is in a single position among its positions of rotation.

8. The apparatus according to claim 7 wherein said single position occurs between where said pallet normally obtains glue from said glue source and where said pallet normally obtains a label from said source of labels.

9. Apparatus for labeling a series of bottles and the like including a rotating turret, a glue applicator roll, a container for labels and a label transfer member arranged about the turret in that order of rotation, and a plurality of oscillatable curved glue pallets mounted on the turret on a common circle for said pallets to be coated with glue and pick up a label and deposit said label on said transfer member if a bottle is present to receive the label and for said pallets to pass by the label container and the cylinder and glue applicator roll if a bottle is not present, comprising:

means mounting said turret for rotation about a central axis, means for rotating the turret continuously, a plurality of drive shafts journaled for oscillating in the turret and in parallelism with said axis, said shafts being arranged in a circular pattern equidistant from said axis, a cam contour arranged around said axis and over most of its length varying in distance from said axis, a gear fixed on each of said shafts and a gear segment mounted for swinging on each of said shafts, the segment on one shaft being meshed with the gear on an adjacent shaft, cam follower means on each gear segment engaged with said cam contour and attached to the segment to oscillate the segments through an angle depending on the contour as the turret rotates to thereby oscillate the shaft having the gear, a drive member having one planar surface and mounted for free rotation on an end portion of each drive shaft and a pallet shaft on which a said curved pallet is fixed eccentrically and which is coupled to said drive member, said drive member having a recess in its periphery, a clutch member slidable axially on said drive member and engaged with the drive member for joint rotation, said drive shaft having a planar surface axially adjacent said planar surface on the drive member and one of said surfaces having recesses and the other having teeth registrable in the teeth for connecting the drive shaft and clutch member in driving relation, a pneumatic cylinder fixed to said turret and having a piston therein and a piston rod comprising a locking member adapted to be registered in said recess in the periphery of the clutch member, said cylinder having ports communicating respectively, with opposite sides of the piston, a cylinder rotating coaxially with said turret and having openings that communicate with said ports, respectively, only when the pallet associated with said cylinder is in radially retracted position under control of said cam members, a control valve for supplying the openings with compresses air, a missing bottle detector responsive to a missing bottle or bottles by causing said control valve to apply pressure to said piston to engage said locking member with said clutch member to stop its rotation and thereby disengage said teeth from said recesses so the drive shaft will not oscillate said pallet shaft drive member, as the drive shaft oscillates to a limited extent and said pallet remains locked in retracted position, said detector causing said control valve to apply pressure to said piston in a direction that will disengage said locking member when said pallet returns to the said retracted position on the next revolution if said detector detects the presence of a bottle then.

* * * * *